US010465670B2

(12) United States Patent
Tsai

(10) Patent No.: US 10,465,670 B2
(45) Date of Patent: Nov. 5, 2019

(54) INFLATING DEVICE

(71) Applicant: Dongguan Tiger Point Metal & Plastic Products Co., Ltd., Dongguan, Guang Dong Province (CN)

(72) Inventor: Chun-Chung Tsai, New Taipei (TW)

(73) Assignee: DONGGUAN TIGER POINT METAL & PLASTIC PRODUCTS CO., LTD., Dongguan, Guang Dong Province (CN)

( * ) Notice: Subject to any disclaimer, the term of this patent is extended or adjusted under 35 U.S.C. 154(b) by 0 days.

(21) Appl. No.: 16/423,463

(22) Filed: May 28, 2019

(65) Prior Publication Data

US 2019/0277273 A1 Sep. 12, 2019

Related U.S. Application Data

(63) Continuation-in-part of application No. 15/221,759, filed on Jul. 28, 2016.

(51) Int. Cl.

| | |
|---|---|
| ***F04B 33/00*** | (2006.01) |
| ***F04B 27/00*** | (2006.01) |
| ***F04B 35/06*** | (2006.01) |
| ***F04B 41/06*** | (2006.01) |
| ***F04B 19/02*** | (2006.01) |
| ***F04B 37/12*** | (2006.01) |

(52) U.S. Cl.

CPC ..... *F04B 33/005* (2013.01); *F04B 19/022* (2013.01); *F04B 27/005* (2013.01); *F04B 35/06* (2013.01); *F04B 37/12* (2013.01); *F04B 41/06* (2013.01)

(58) Field of Classification Search

CPC .. F04B 9/14; F04B 17/06; F04B 19/02; F04B 19/022; F04B 25/005; F04B 25/04; F04B 27/005; F04B 33/00; F04B 33/005; F04B 35/06; F04B 37/10; F04B 37/12; F04B 39/0005; F04B 39/12; F04B 41/06

USPC ..... 417/460, 467, 469, 544

See application file for complete search history.

(56) References Cited

U.S. PATENT DOCUMENTS

| | | | | |
|---|---|---|---|---|
| 4,508,490 A * | 4/1985 | Ramirez | F04B 33/00 | 417/234 |
| 6,257,849 B1 * | 7/2001 | Wu | F04B 33/005 | 417/238 |
| 6,371,741 B1 * | 4/2002 | Wu | F04B 19/02 | 417/446 |

* cited by examiner

*Primary Examiner* — Kenneth J Hansen
*Assistant Examiner* — Chirag Jariwala
(74) *Attorney, Agent, or Firm* — Juan Carlos Marquez; Marquez IP Law Office, PLLC

(57) ABSTRACT

An inflating device includes a main body, an outer cylinder, an inner cylinder, a handle, an inflating tube and a switching structure. The outer cylinder is disposed within the main body and an upper portion of the outer cylinder defines a cavity which has a bottom surface defining a sliding passage. The inner cylinder is disposed within the outer cylinder. The switching structure includes a slide unit and a press cover. The slide unit is disposed slidably in left and right directions within a sliding passage. The press cover is mounted on the upper portion of the outer cylinder so as to cover the cavity and the slide unit. The inflating device can be conveniently switched between a small pump unit and a large pump unit by the switching structure.

10 Claims, 18 Drawing Sheets

INFLATING DEVICE

CROSS-REFERENCES TO RELATED APPLICATIONS

This application is a continuation-in-part of U.S. patent application Ser. No. 15/221,759, filed on Jul. 28, 2016, which is incorporated herewith by reference.

BACKGROUND OF THE INVENTION

1. Field of the Invention

The present invention relates generally to an inflating device, and more particularly to an inflating device switched between a small pump unit and a large pump unit for optionally inflating an inflatable article.

2. The Prior Arts

As we all know, an inflating device is widely used in our daily life for inflating an inflatable article, like a tire of a bicycle, motorbike and a basket ball, thereby providing much convenience to the people. Before the inflatable article is inflated by the conventional inflating device, the inflatable article is in an entirely flat condition and has low internal pressure, a large pump unit should be applied since the same can provide large air flow into the inflatable article and is subject to small air resistance from the inflatable article, so that the inflatable article can be quickly inflated. When the inflatable article is nearly full, has high internal pressure and is inflated continuously by the large pump unit, the large pump unit is subject to high air resistance from the inflatable article and difficult to inflate the inflatable article. When the inflatable article is nearly full and has high internal pressure, a small pump unit should be applied since the same provide small air flow into the inflatable article and is subject to small air resistance from the inflatable article and easy to inflate the inflatable article. In other words, large and small pump units are needed to facilitate inflation of an inflatable article and are beneficial that an inflating device possesses these large and small pump units at the same time. However, the conventional inflating device provides only a constant injection pressure, either large or small injection pressure.

SUMMARY OF THE INVENTION

A primary objective of the present invention is to provide an inflating device, which can be switched between a small pump unit and a large pump unit so as to facilitate and bringing convenience to the user of the inflating device of the present invention.

An inflating device in accordance with the present invention includes a main body, an outer cylinder, an inner cylinder, a handle, an inflating tube and a switching structure.

The main body has a bottom seat, an upper portion and a top cover mounted on and shielding the upper portion of the main body. The top cover defines a first circular hole and a first air inlet.

The outer cylinder is disposed within the main body and has an upper portion that extends through the first circular hole in the top cover of the main body. The upper portion of the outer cylinder defines a cavity, a second air inlet and a second circular hole below the cavity. One side of the cavity defines a first notch and the other side of the cavity defines an opening. The cavity has a bottom surface defining a sliding passage. A first air chamber is defined between an outer surface of the outer cylinder and an inner surface of the main body. The first air inlet in the top cover is in communication with the first air chamber. The outer cylinder has a bottom portion and the bottom portion of the outer cylinder has a first piston. A first outer slit is defined between an outer surface of the first piston and the inner surface of the main body. The first outer slit is communication with the first air chamber.

The inner cylinder is disposed within the outer cylinder and has an upper portion that extends through the second circular hole of the outer cylinder. A second air chamber is defined between an outer surface of the inner cylinder and an inner surface of the outer cylinder. The second air inlet of the outer cylinder is in communication with the second air chamber. The inner cylinder has a bottom portion and the bottom portion of the inner cylinder has a second piston and a one-way valve. A first inner slit is defined between an outer surface of the second piston and the inner surface of the outer cylinder. The first inner slit is in communication with the second air chamber.

The handle has an air outlet and a lower portion for coupling with the upper portion of the inner cylinder and abutting against the upper portion of the outer cylinder and is formed with an engagement groove.

The inflating tube is connected securely with the air outlet of the handle.

The switching structure includes a slide unit and a press cover. The slide unit is disposed slidably in left and right directions within the sliding passage and defines a third circular hole and has two opposite pulling portions. The press cover is mounted on the upper portion of the outer cylinder so as to cover the cavity and the slide unit and has a fourth circular hole in alignment with the third circular hole in the slide unit and a pair of second notches in alignment with the first notch and the opening of the cavity and permitting extension of the pulling portions of the slide unit through the first notch and the opening of the cavity and the second notches of the press cover. The slide unit is located between the upper portion of the outer cylinder and the press cover.

Wherein the lower portion of the handle extends slidably and axially through the fourth circular hole in the press cover and the third circular hole in the slide unit for securely coupling to the upper portion of the inner cylinder in such a manner that the engagement groove selectively engages an inner periphery defining the third circular hole in the slide unit.

Wherein the cavity further has at least one restricting post mounted erectly on a bottom surface of the sliding passage, the slide unit is formed with at least one slide limit slot to permit extension of the at least one restricting post in order to restrict sliding action of the slide unit in the left and right directions.

Wherein the press cover has a bottom side surface formed with at least one connection post, the at least one connection post of the press cover is in connection with the at least one restricting post of the outer cylinder in such a manner that the press cover and the outer cylinder are securely connected to each other.

Wherein when the slide unit slides within the sliding passage in the left and right directions and the inner periphery defining the third circular hole in the slide unit disengaging from the engagement groove of the handle, the slide unit is separated from the handle, the handle is pulled up or pushed down and pulls or pushes the inner cylinder to move up or down with respect to the outer cylinder and the main body.

Wherein when the slide unit slides within the sliding passage in the left and right directions and the inner periphery defining the third circular hole in the slide unit engages to the engagement groove of the handle, the slide unit is in connection with the handle, the handle is pulled up and pulls the slide unit and the inner cylinder to move up together, while the slide unit pushes the press cover up, and the press cover pulls the outer cylinder to move up with respect to the main body.

Wherein when the slide unit slides within the sliding passage in the left and right directions and the inner periphery defining the third circular hole in the slide unit engages to the engagement groove of the handle, the slide unit is in connection with the handle, the handle is pushed down and pushes the slide unit and the outer and inner cylinders to move down together with respect to the main body, while the outer cylinder pulls the press cover to move down.

Preferably, the slide unit includes a slide plate having two opposite ends from which the pulling portions extend outwardly inclinedly with respect to the slide plate and two lateral sides interconnecting the opposite ends and formed with protrusions, the sliding passage is defined by two parallel side surfaces formed with a pair of restricting notches such that the protrusions respectively extend into the restricting notches to alternately engage two opposite ends of a respective one of the restricting notches when the slide plate slides within the sliding passage in the left and right directions.

Preferably, the cavity has two restricting posts mounted erectly on the bottom surface of the sliding passage, the slide plate is formed with a pair of slide limit slots to permit extension of the two restricting posts in order to restrict sliding action of the slide plate in the left and right directions.

Preferably, the top cover further defines an annular inner edge at a bottom side thereof, the slide plate has an extension portion below one of the pulling portions, the opening of the cavity is configured to permit extension of the extension portion prior to extending into the annular inner edge of the top cover.

Preferably, the second air inlet of the outer cylinder is formed through the bottom surface of the sliding passage, and is constituted by a plurality of elongated slots and a plurality of third notches formed along an inner periphery defining the second circular hole of the outer cylinder.

Preferably, a plurality of first air inlets are formed around a section of an outer periphery of the top cover.

Preferably, the bottom side surface of the press cover is formed with a plurality of connection posts, the cavity further has a plurality of restricting posts mounted erectly on the bottom surface of the sliding passage, the connection posts of the press cover are in connection with the restricting posts of the outer cylinder in such a manner that the press cover and the outer cylinder are securely connected to each other, a confining curved plate interconnecting adjacent two of connection posts so as to restrict sliding action of the slide unit in the left and right directions and the upward and downward directions within the sliding passage, each of curved plates is located in front of each of the pulling portions and is located above the slide plate; and wherein the slide unit further includes a pair of finger-grips respectively and upwardly extending from distal ends of the pulling portions to facilitate manipulation of the pulling portions in the left and right directions.

Preferably, the one-way valve is constituted by an air aperture formed through the bottom portion of the inner cylinder and a floating shield floatingly covering the air aperture, the bottom portion of the inner cylinder further has a lowermost surface with the air aperture being located at an elevation above and extending through the lowermost surface while the floating shield is disposed within the inner cylinder for floatingly covering the air aperture.

Preferably, the outer surface of the first piston is formed with a first annular recess, in which, a first seal ring is disposed in the first annular recess, a second outer slit is defined between the outer surface of the first piston and a top surface of the first seal ring, and the second outer slit is selectively in communication with the first outer slit, a third outer slit is defined between the outer surface of the first piston and an inner surface of the first seal ring, and the third outer slit is in communication between the second outer slit and the first annular recess; and wherein the outer surface of the second piston is formed with a second annular recess, in which, a second seal ring is disposed in the second annular recess, a second inner slit is defined between the outer surface of the second piston and a top surface of the second seal ring, and the second inner slit is selectively in communication with the first inner slit, a third inner slit is defined between the outer surface of the second piston and an inner surface of the second seal ring, and the third inner slit is in communication between the second inner slit and the second annular recess.

Preferably, the press cover has an external wall surface formed with a plurality of grip-portions to facilitate gripping of the press cover during mounting of the press cover on the upper portion of the outer cylinder.

An important aspect to note that since the outer cylinder is disposed within the main body and the inner cylinder is disposed within the outer cylinder, and the slide unit can selectively connect to the handle, the inflating device of the present invention can be switched between two different modes which are a small pump unit and a large pump unit by the switching structure 60, the inflating ability thereof is enhanced. The user can optionally switch to a desired mode (the small pump unit or the large pump unit) according to the circumstance requires.

Moreover, the switching structure has simple structure and is easy to be install. When the inflatable article is inflated by the inflating device of the present invention, the slide unit slides within the sliding passage in the left and right directions so as to be separated from or in connection with the handle, the inflating device of the present invention can be switched between the small pump unit and the large pump unit. This kind of switching means is very fast and has high efficiency.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
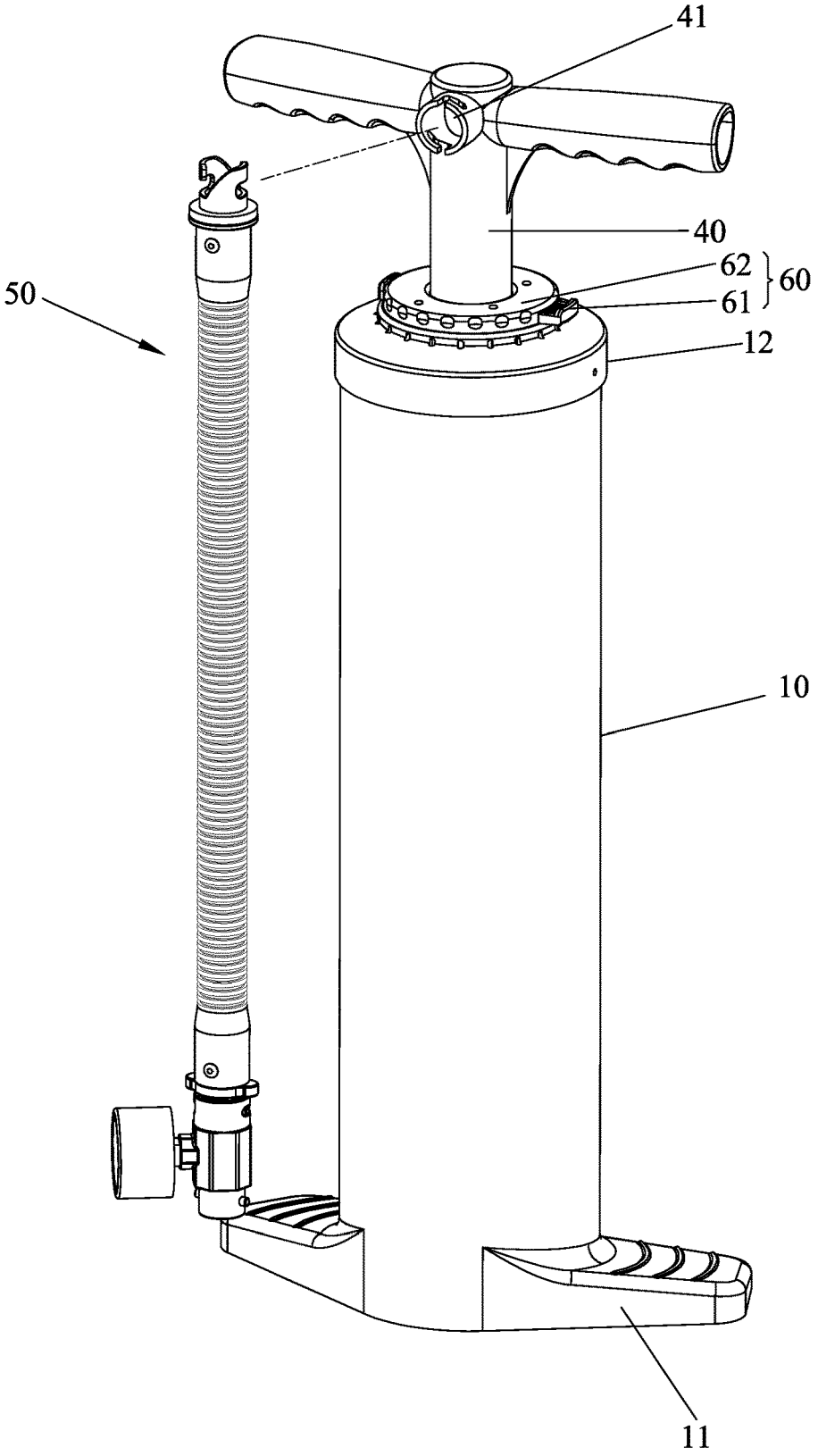
FIG. 1 is a perspective view of an inflating device of the present invention.
Figure 2:
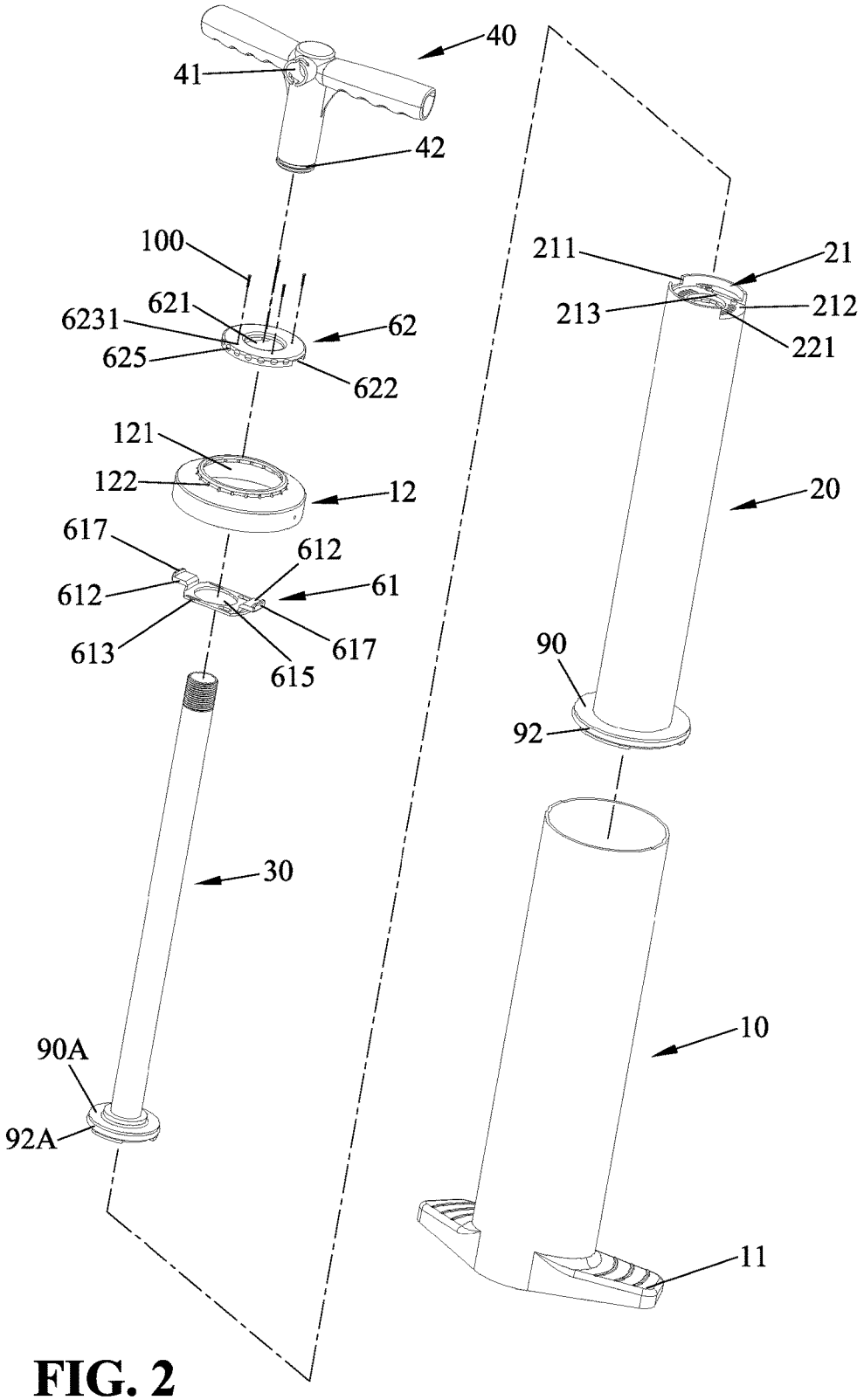
FIG. 2 is an exploded and perspective view of the inflating device of the present invention.

Referring to FIGS. 1 and 2, wherein FIG. 1 is a perspective view of an inflating device of the present invention; and FIG. 2 is an exploded and perspective view of the inflating device of the present invention. As shown, an inflating device of the present invention includes a main body 10, an outer cylinder 20, an inner cylinder 30, an handle 40, an inflating tube 50 and a switching structure 60.

Figure 3:
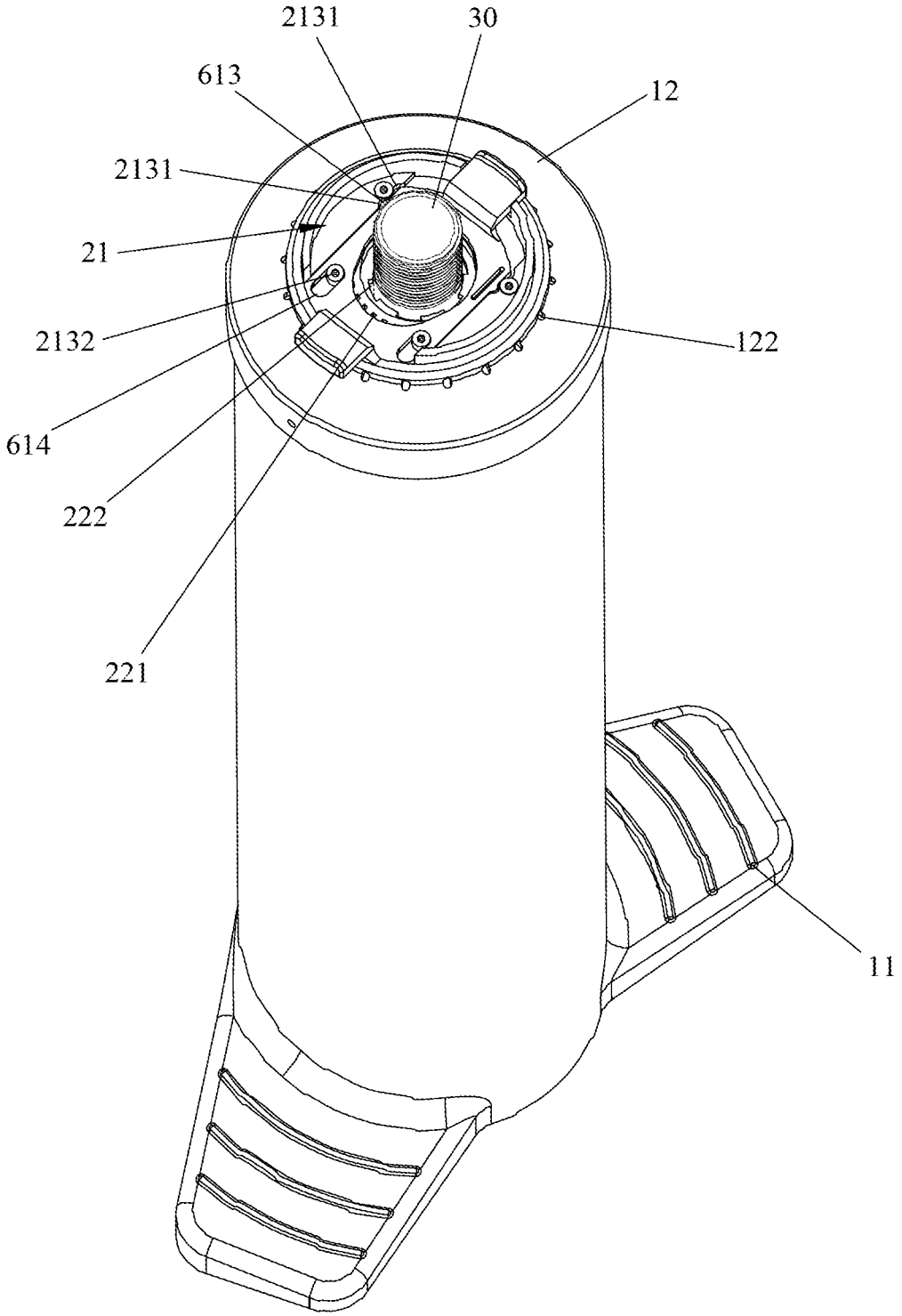
FIG. 3 illustrates how a slide unit is mounted on an upper portion of an outer cylinder employed in the inflating device of the present invention.
Figure 7:
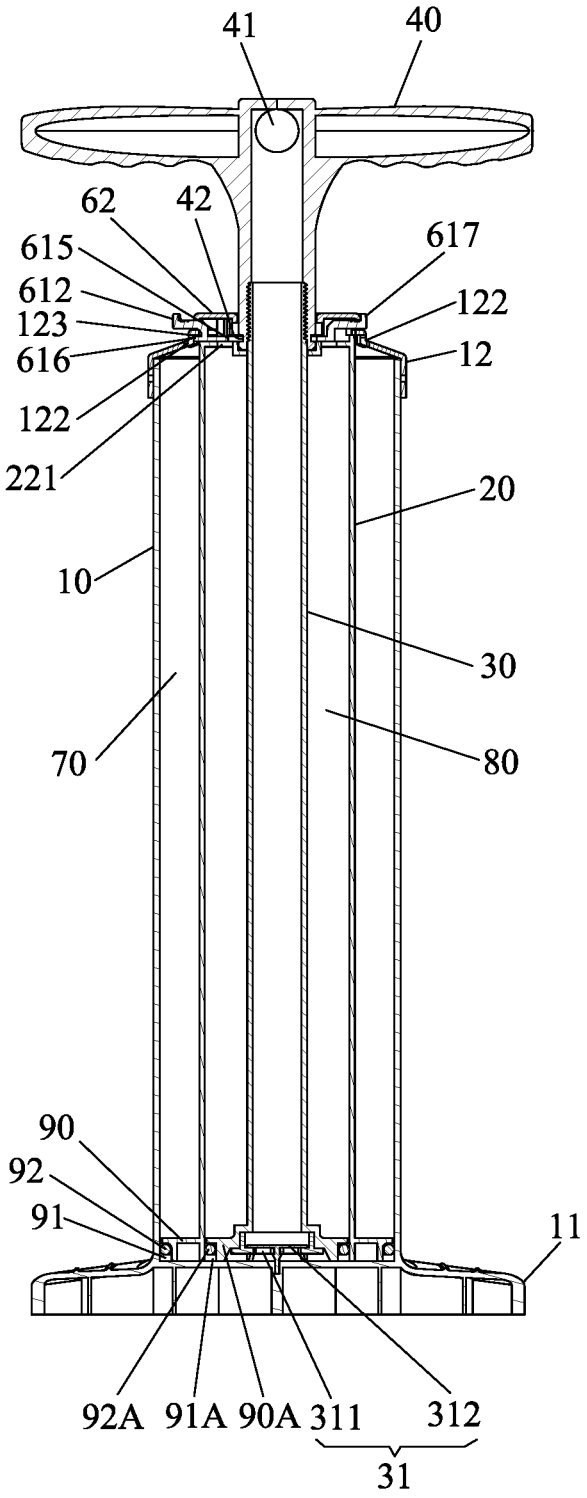
FIG. 7 is a cross-sectional view of the inflating device of the present invention, where the inflating device is switched into a small pump unit.

As shown in FIGS. 1 to 3, the main body 10 has a bottom seat 11, an upper portion and a top cover 12 mounted on and shielding the upper portion of the main body 10. The top cover 12 defines a first circular hole 121 and a plurality of first air inlets 122 formed around a section of an outer periphery of the top cover 12. As shown in FIG. 7, the top cover 12 further defines an annular inner edge 123 at a bottom side thereof.

Figure 8:
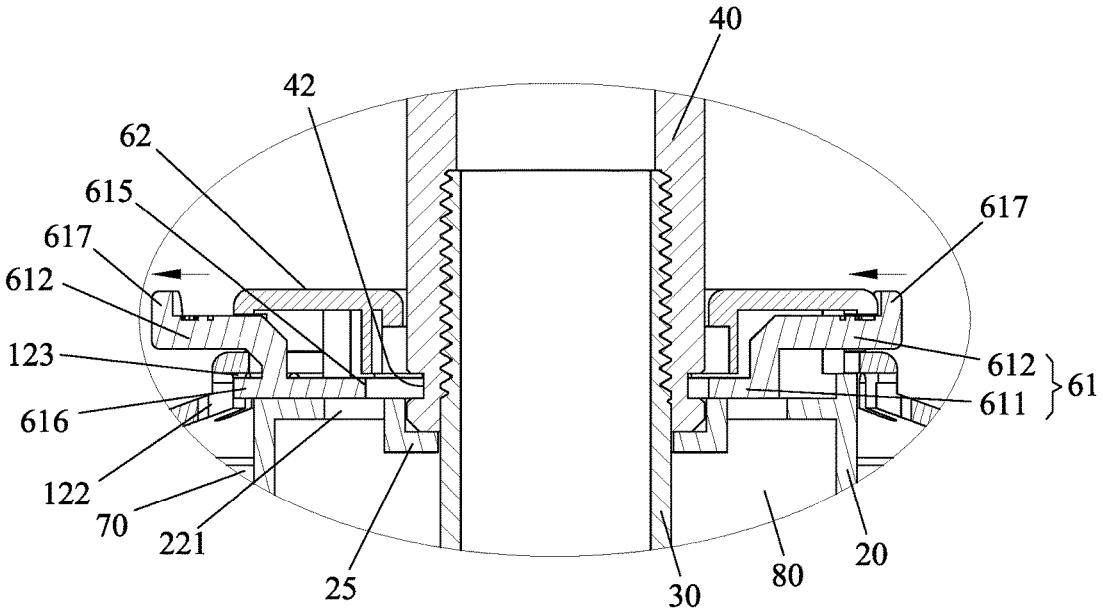
FIG. 8 is an enlarged cross-sectional view of FIG. 7 showing that the switching structure and some elements near the switching structure are enlarged to clarify its structure condition.
Figure 9:
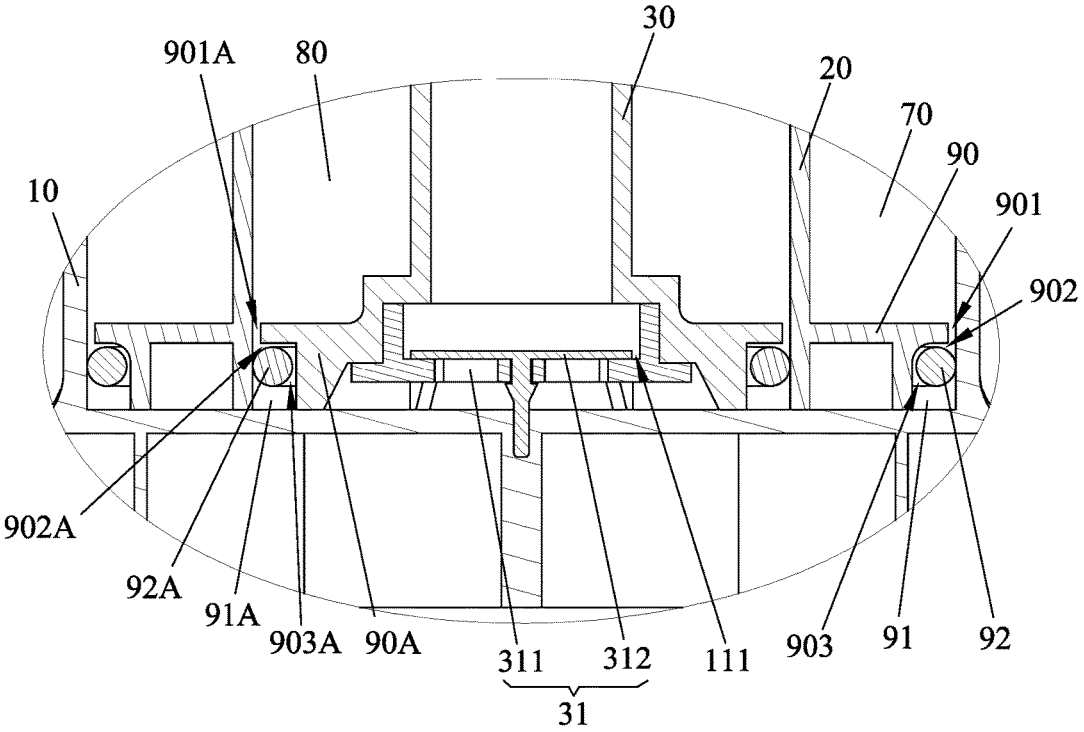
FIG. 9 is an enlarged cross-sectional view of FIG. 7 showing that bottom portions of the outer and inner cylinders and some elements near bottom portions of the outer and inner cylinders are enlarged to clarify its structure condition.

As shown in FIGS. 1 to 4, the outer cylinder 20 is disposed within the main body 10 and has an upper portion that extends through the first circular hole 121 in the top cover 12 of the main body 10. The upper portion of the outer cylinder 20 defines a cavity 21, a second air inlet 22 and a second circular hole 23 below the cavity 21. One side of the cavity 21 defines a first notch 211, the other side of the cavity 21 defines an opening 212, and the cavity 21 has a bottom surface defining a sliding passage 213. The second air inlet 22 is formed through a bottom surface of the sliding passage 213, and is constituted by a plurality of elongated slots 221 and a plurality of third notches 222 formed along an inner periphery defining the second circular hole 23 of the outer cylinder 20. More specifically, a large diameter hole 24 is formed through the bottom surface of the sliding passage 213 and in communication between the sliding passage 213 and the second circular hole 23, and has a diameter greater than a diameter of the second circular hole 23, such that a step 25 is defined between an inner periphery defining the large diameter hole 24 and the inner periphery defining the second circular hole 23. Some of the elongated slots 221 are located between the large diameter hole 24 and the first notch 211 of the cavity 21, some of the elongated slots 221 are located between the large diameter hole 24 and the opening 212 of the cavity 21, and the third notches 222 are in communication with the second circular hole 23 respectively. As shown in FIGS. 7 and 8, a first air chamber 70 is defined between an outer surface of the outer cylinder 20 and an inner surface of the main body 10, and the first air inlets 122 in the top cover 12 are in communication with the first air chamber 70 respectively. As shown in FIGS. 7 and 9, the outer cylinder 20 has a bottom portion and the bottom portion of the outer cylinder 20 has a first piston 90, a first outer slit 901 is defined between an outer surface of the first piston 90 and the inner surface of the main body 10, and the first outer slit 901 is in communication with the first air chamber 70. The outer surface of the first piston 90 is formed with an first annular recess 91, and a first seal ring 92 is disposed in the first annular recess 91. A second outer slit 902 is defined between the outer surface of the first piston 90 and a top surface of the first seal ring 92, and the second outer slit 902 is selectively in communication with the first outer slit 901. A third outer slit 903 is defined between the outer surface of the first piston 90 and an inner surface of the first seal ring 92, and the third outer slit 903 is in communication between the second outer slit 902 and the first annular recess 91.

As shown in FIGS. 1 to 3, the inner cylinder 30 is disposed within the outer cylinder 20 and has an upper portion that extends through the second circular hole 23 of the outer cylinder 20. As shown in FIGS. 7 and 8, a second air chamber 80 is defined between an outer surface of the inner cylinder 30 and an inner surface of the outer cylinder 20, and the elongated slots 221 and the third notches 222 of the second air inlet 22 are in communication with the second air chamber 80 respectively. As shown in FIGS. 7 and 9, the inner cylinder 30 has a bottom portion and the bottom portion of the inner cylinder 30 has a second piston 90A and a one-way valve 31. A first inner slit 901A is defined between an outer surface of the second piston 90A and the inner surface of the outer cylinder 20, and the first inner slit 901A is in communication with the second air chamber 80. The outer surface of the second piston 90A is formed with an second annular recess 91A, and a second seal ring 92A is disposed in the second annular recess 91A. A second inner slit 902A is defined between the outer surface of the second piston 90A and a top surface of the second seal ring 92A, and the second inner slit 902A is selectively in communication with the first inner slit 901A. A third inner slit 903A is defined between the outer surface of the second piston 90A and an inner surface of the second seal ring 92A, and the third inner slit 903A is in communication between the second inner slit 902A and the second annular recess 91A. As shown in FIGS. 7 and 9, the one-way valve 31 is constituted by an air aperture 311 formed through the bottom portion of the inner cylinder 30 and a floating shield 312 floatingly covering the air aperture 311. A gap 111 is defined between an outer surface of the floating shield 312 and the inner surface of the inner cylinder 30. Note that the bottom portion of the inner cylinder 20 further has a lowermost surface with the air aperture 311 being located at an elevation above and extending through the lowermost surface while the floating shield 312 is disposed within the inner cylinder 30 for floatingly covering the air aperture 311.

As shown in FIGS. 2, 7 and 8, the handle 40 has an air outlet 41 and a lower portion for coupling with the upper portion of the inner cylinder 30 and abutting against the step 25 on the upper portion of the outer cylinder 20 and is formed with an engagement groove 42. Preferably, the lower portion of the handle 70 is screwed on the upper portion of the inner cylinder 30.

As shown in FIG. 1, the inflating tube 50 is connected securely with the air outlet 41 of the handle 40.

The switching structure 60 is provided for switching between large and small pressures, or large pump unit and small pump unit. As shown in FIGS. 1 and 2, the switching structure 60 includes a slide unit 61 and a press cover 62.

Figure 4:
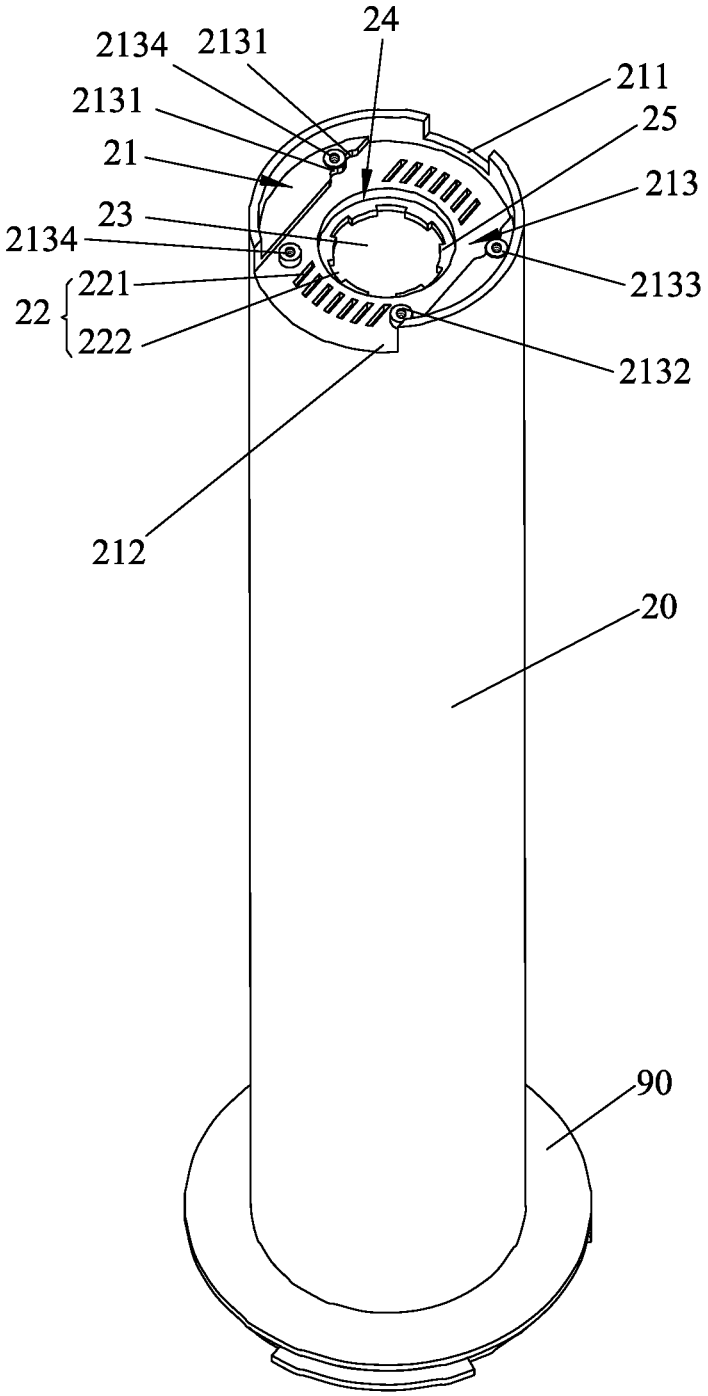
FIG. 4 shows a perspective view of the outer cylinder employed in the inflating device of the present invention.
Figure 5:
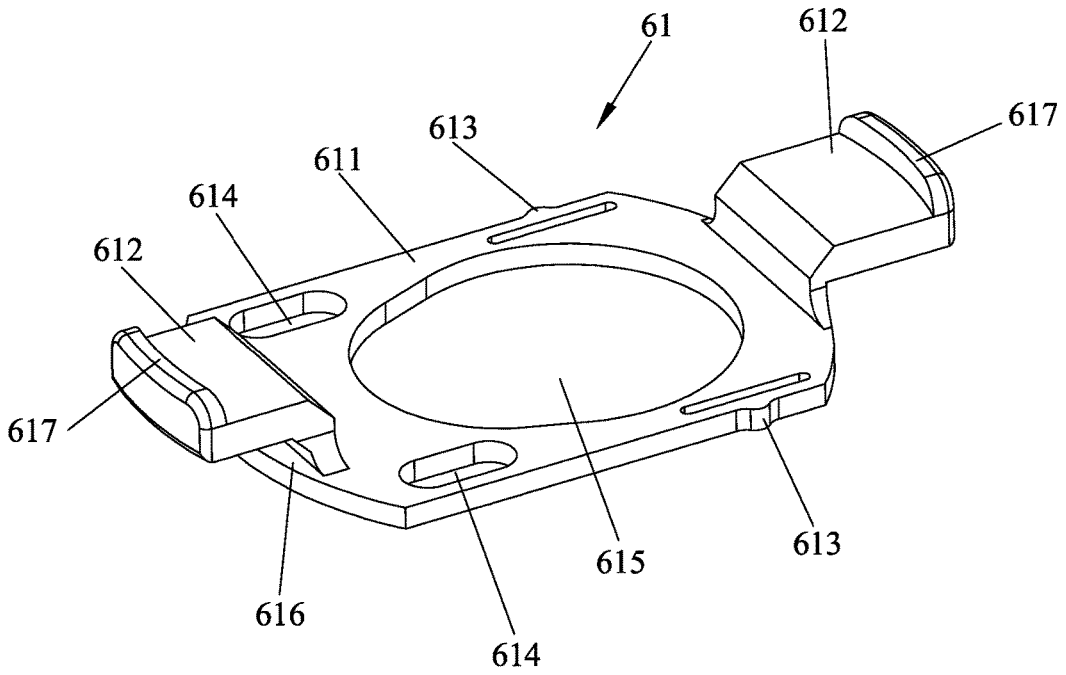
FIG. 5 illustrates a perspective view of the slide unit employed in the inflating device of the present invention.

As shown in FIGS. 3 to 5, the slide unit 61 is disposed slidably in left and right directions within the sliding passage 213 and defines a third circular hole 615. More specifically, the slide unit 61 includes a slide plate 611 having two opposite ends, from which two pulling portions 612 extend outwardly inclinedly with respect to the slide plate 611 and two lateral sides interconnecting the opposite ends and are formed with two protrusions 613. The configuration of the slide plate 611 matches to the sliding passage 213 and the opening 212 of the cavity 21, such that the slide plate 611 is capable of sliding within the sliding passage 213 in the left and right directions, and one end of the slide plate 611 extends through the opening 212 of the cavity 21 to exterior of the outer cylinder 20. The sliding passage 213 is defined by two parallel side surfaces formed with a pair of restricting notches 2131 such that the protrusions 613 of the slide plate 611 respectively extend into the restricting notches 2131 to alternately engage two opposite ends of a respective one of the restricting notches 2131 when the slide plate 611 slides within the sliding passage 213 in the left and right directions, thereby preventing the slide plate 611 from shifting. The cavity 21 further has two restricting posts 2132 mounted erectly on the bottom surface of the sliding passage 213. The slide plate 611 is formed with a pair of slide limit slots 614 to permit extension of the two restricting posts 2132 in order to restrict sliding action of the slide plate 611 in the left and right directions. As shown in FIGS. 5, 7 and 8, the slide plate 611 has an extension portion 616 below one of the pulling portions 612. The opening 212 of the cavity 21 is configured to permit extension of the extension portion 616 of the slide plate 611 prior to extending into the annular inner edge 123 of the top cover 12. In other words, the opening 212 has a width larger than the first notch 211 to permit extension of the extension of the slide plate 611 when the latter sides in the left direction for covering the first air inlet 122 of the top cover 12. Note that the slide unit 61 further includes a pair of finger-grips 617 respectively and upwardly extend from distal ends of the pulling portions 612 to facilitate manipulation of the pulling portions 612 in the left and right directions by a user's finger. As shown in FIG. 4, a restricting post 2133 is disposed adjacent two restricting notches 2131.

Figure 6:
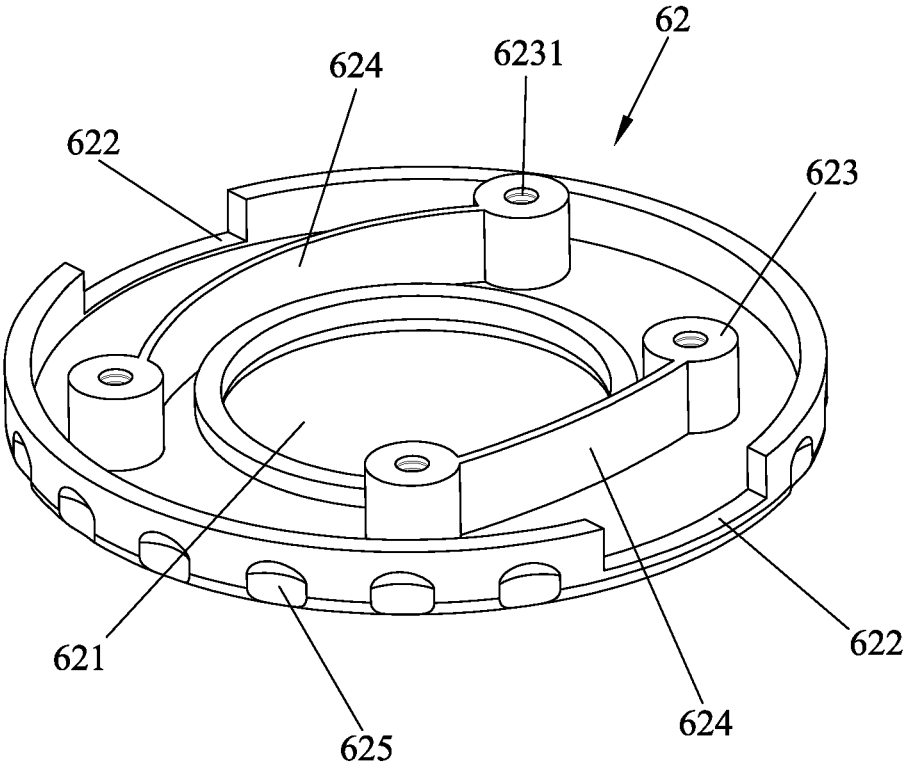
FIG. 6 illustrates a perspective bottom view of a press cover employed in the inflating device of the present invention.

As shown in FIGS. 1, 2 and 6, the press cover 62 is mounted on the upper portion of the outer cylinder 30 so as to cover the cavity 21 and slide plate 611. In other words, the slide plate 611 is located between the upper portion of the outer cylinder 20 and the press cover 62, and a space defined between the slide plate 611 and the press cover 62. As shown in FIGS. 2, 6, 7 and 8, the press cover 62 has a fourth circular hole 621 in alignment with the third circular hole 615 in the slide plate 611 and a pair of second notches 622 at an outer periphery of the press cover 62 in alignment with the first notch 211 and the opening 212 of the cavity 21 and permitting extension of the pulling portions 612 of the slide plate 611 through the first notch 211 and the opening 212 of the cavity 21 and the second notches 622 of the press cover 62. As shown in FIGS. 2, 7 and 8, the lower portion of the handle 40 extends slidably and axially through the fourth circular hole 621 in the press cover 62 and the third circular hole 615 in the slide plate 611 for securely coupling to the upper portion of the inner cylinder 30 in such a manner that the engagement groove 42 selectively engaging an inner periphery defining the third circular hole 615 in the slide plate 611. The press cover 62 has a bottom side surface formed with two pairs of connection posts 623, the connection posts 623 of the press cover 62 are in connection with the restricting posts 2132, 2133 of the outer cylinder 20 in such a manner that the press cover 62 and the outer cylinder 20 are securely connected to each other. More specifically, as shown in FIGS. 2, 4 and 6, each of the restricting posts 2132, 2133 is formed with a threaded hole 2134, each of the connection posts 623 is formed with a threaded hole 6231, and four fasteners 100 are screwed into the threaded holes 2134 of the restricting posts 2132, 2133 and the threaded holes 6231 of the connection posts 623 respectively. Therefore, the press cover 62 and the outer cylinder 20 are securely connected to each other by the fasteners 100. A pair of confining curved plates 624 interconnecting the pairs of connection posts 623 so as to restrict sliding action of the slide plate 611 in the left and right directions and in the upward and downward directions within the sliding passage 213, each of curved plates 624 is located in front of each of the pulling portions 612 and is located above the slide plate 611, which in turn, provides stable sliding action of the slide plate 611 in the left and right directions, and along upward and downward movement of the slide plate 611 in the sliding passage 213, thereby preventing the slide plate 611 from sliding over a predetermined distance. In addition, the press cover 62 has an external wall surface formed with a plurality of grip-portions 625 to facilitate gripping of the press cover 62 during mounting of the press cover 62 on the upper portion of the outer cylinder 20 or dismantling therefrom.

To further understand the inflating device of the present invention, please see the following paragraphs.

Figure 10:
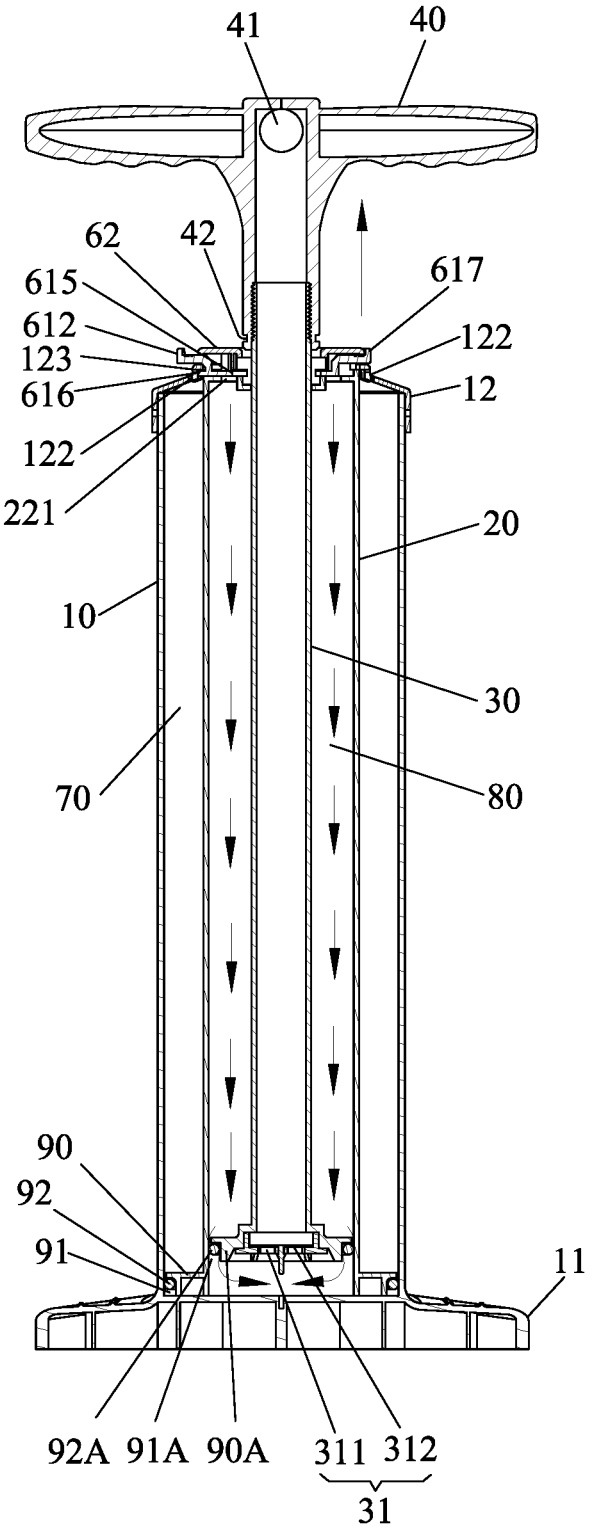
FIG. 10 is a cross-sectional view of the inflating device of the present invention showing that a handle drives the inner cylinder to move upward with respect to the outer cylinder.
Figure 11:
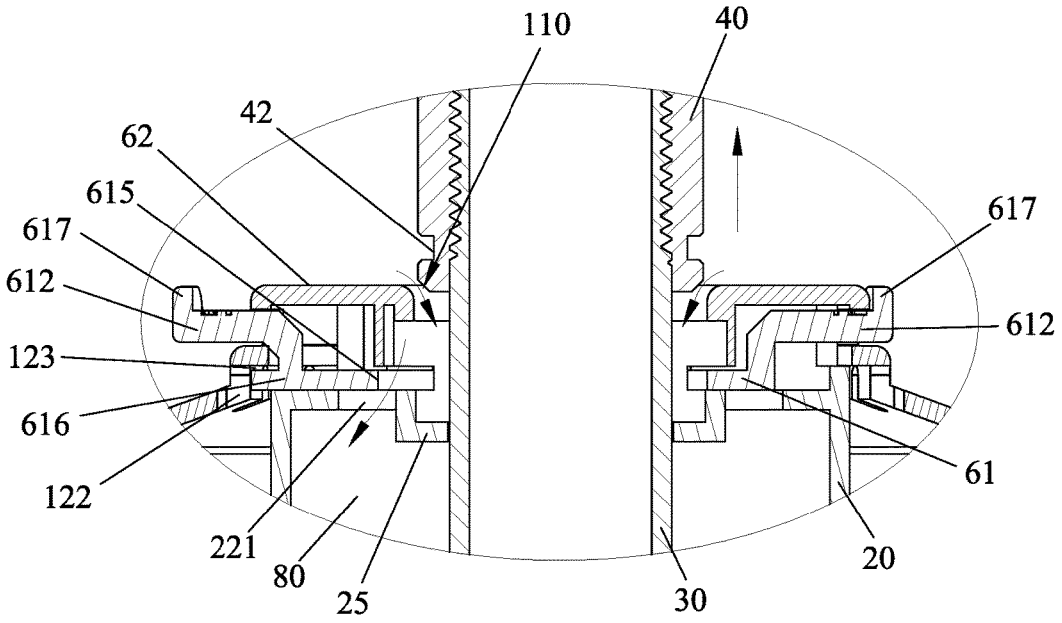
FIG. 11 is an enlarged cross-sectional view of FIG. 10 showing that the switching structure and some elements near the switching structure are enlarged to clarify its structure condition.
Figure 12:
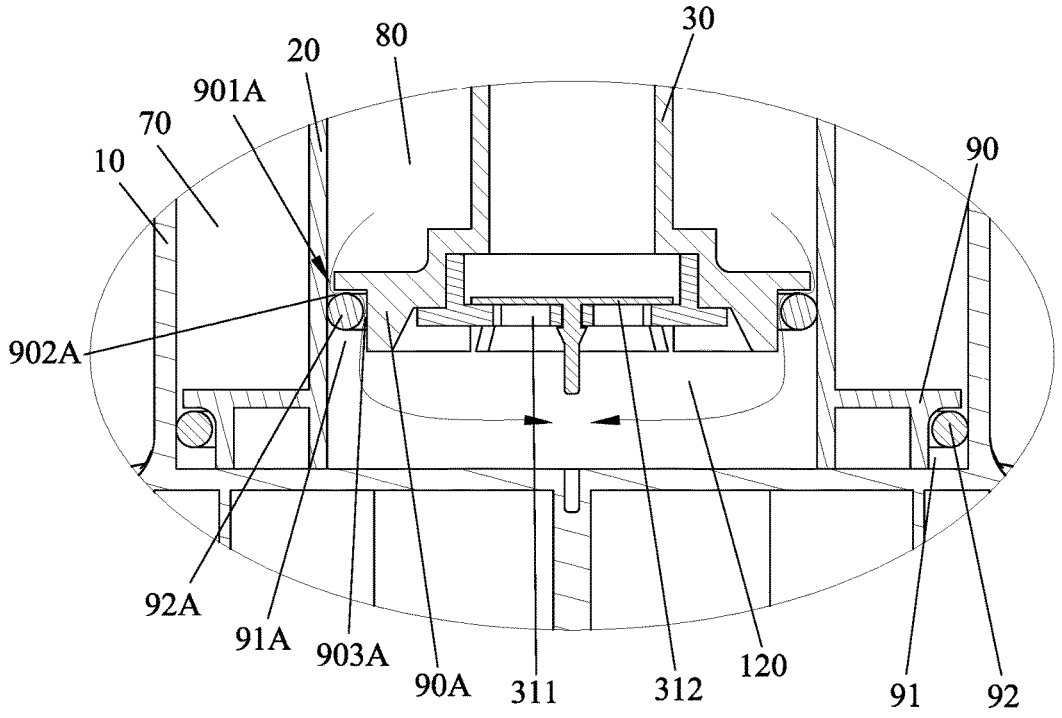
FIG. 12 is an enlarged cross-sectional view of FIG. 10 showing that bottom portions of the outer and inner cylinders and some elements near bottom portions of the outer and inner cylinders are enlarged to clarify its structure condition.

As best shown in FIGS. 7 and 8, the user's fingers hold the pulling portions 612 of the slide unit 61, and pull the slide plate 611 to slide within the sliding passage 213 in the left direction. Note that once the slide plate 611 is moved to the left direction in the sliding passage 213, until one side of the outer periphery of the press cover 62 abuts against one of the finger-grips 617, the inner periphery defining the third circular hole 615 in the slide plate 611 disengages from the engagement grove 42 of the handle 40, and the slide plate 611 is separated from the handle 40. As best shown in FIGS. 10 to 12, the user's hands hold the handle 40 and pull it up. The handle 40 is pulled up and pull the inner cylinder 30 to move up with respect to the outer cylinder 20 and the main body 10. A gap 110 is defined between an outer periphery of the handle 40 and an inner periphery of the fourth circular hole 621 of the press cover 62 and the second air inlet 22 of the outer cylinder 20 is exposed to the atmosphere (permitting air to enter the second air chamber 80). Air can flow through the gap 110, the space defined between the slide plate 611 and the press cover 62, the third circular hole 615 and the second air inlet 22 including the elongated slots 221 and the third notches 222 in turn and enter into the second air chamber 80. A pump chamber 120 is defined under the inner cylinder 30 after the inner cylinder 30 is moved up. When the inner cylinder 30 is moved up, the top surface of the second seal ring 92A is away from the outer surface of the second piston 90A and does not seal the second inner slit 902A, so that the second inner slit 902A is open and can be in communication with the first inner slit 901A. Therefore, the air in the second air chamber 80 can flow through the first inner slit 901A, second inner slit 902A, third inner slit 903A and second annular recess 91A in turn and enter into the pump chamber 120 under the inner cylinder 30.

Figure 13:
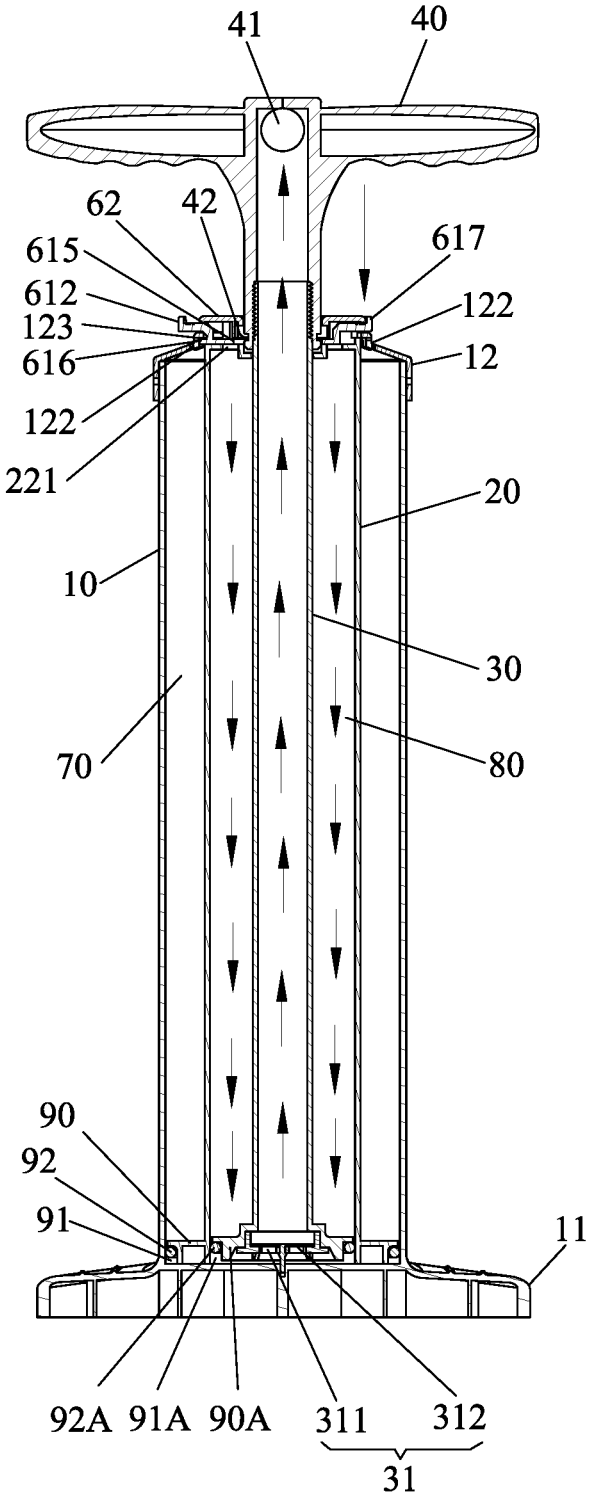
FIG. 13 is a cross-sectional view of the inflating device of the present invention showing that the handle drives the inner cylinder to move downward with respect to the outer cylinder.
Figure 14:
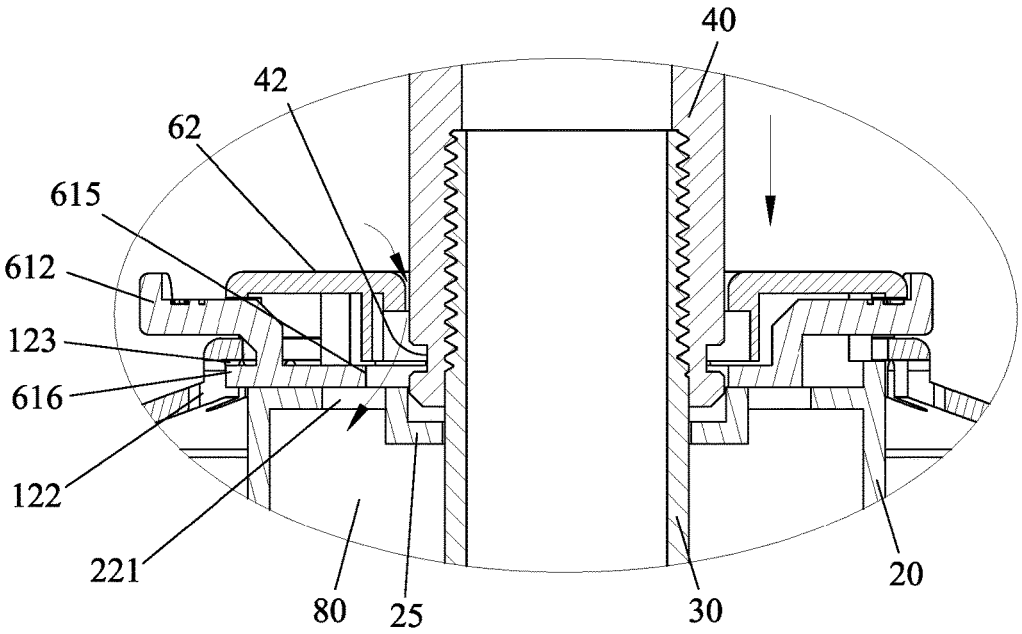
FIG. 14 is an enlarged cross-sectional view of FIG. 13 showing that the switching structure and some elements near the switching structure are enlarged to clarify its structure condition.
Figure 15:
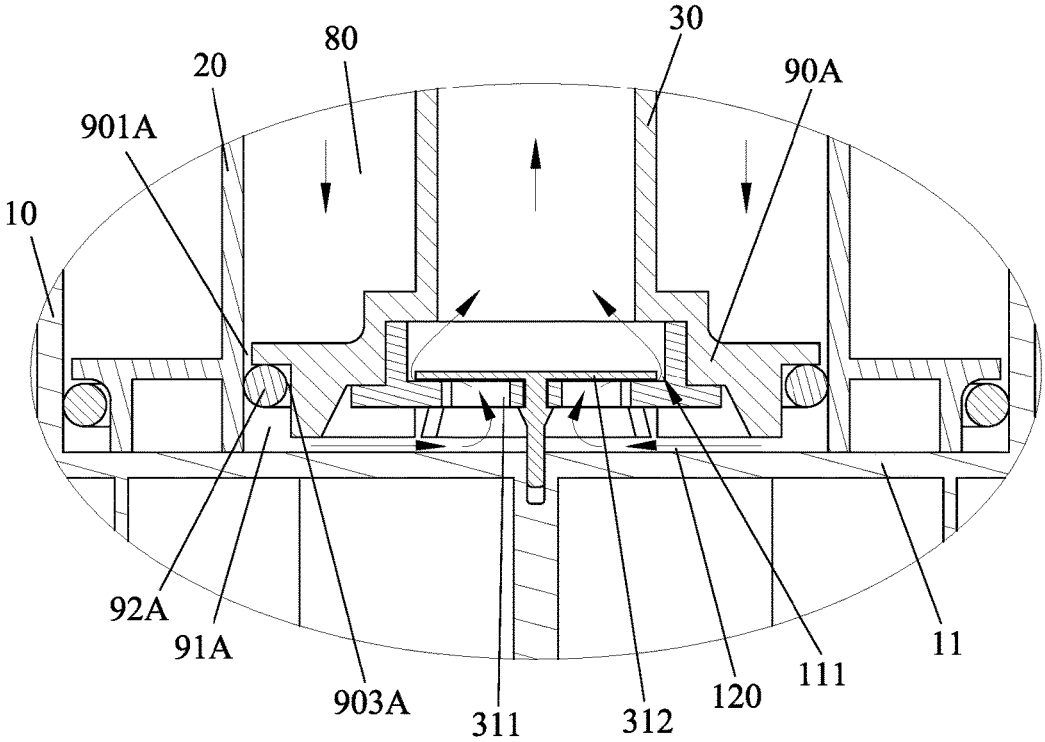
FIG. 15 is an enlarged cross-sectional view of FIG. 13 showing that bottom portions of the outer and inner cylinders and some elements near bottom portions of the outer and inner cylinders are enlarged to clarify its structure condition.

As shown in FIGS. 13 to 15, the user's hands push the handle 40 down. The handle 40 is pushed down and pushes the inner cylinder 30 to move down with respect to the outer cylinder 20 and the main body 10. When the inner cylinder 30 is moved down, the top surface of the second seal ring 92A abuts against the outer surface of the second piston 90A and seals the second inner slit 902A, so that the second inner slit 902A is sealed by the second seal ring 92A and cannot be in communication with the first inner slit 901A. The air in the second air chamber 80 cannot flow through the second inner slit 902A so that the air in the second air chamber 80 cannot enter into the pump chamber 120 under the inner cylinder 30. The second piston 90A pushes down the air in the pump chamber 120 under the inner cylinder 30 and the air flows through the air aperture 311 to blow the floating shield 312 up and further flows through the gap 111 defined between the outer surface of the floating shield 312 and the inner surface of the inner cylinder 30 into an interior of the inner cylinder 30. Finally, as best shown in FIG. 13, the air in the interior of the inner cylinder 30 flows through the air outlet 41 of the handle 40 and the inflating tube 50 and enter into an inflatable article (not shown). In other words, the inflating device of the present invention provides a small injection pressure upon downward movement of the handle 40 together with the inner cylinder 30 with respect to the outer cylinder 20 and the main body 10. Therefore, the inflating device of the present invention serves as a small pump unit.

Figure 16:
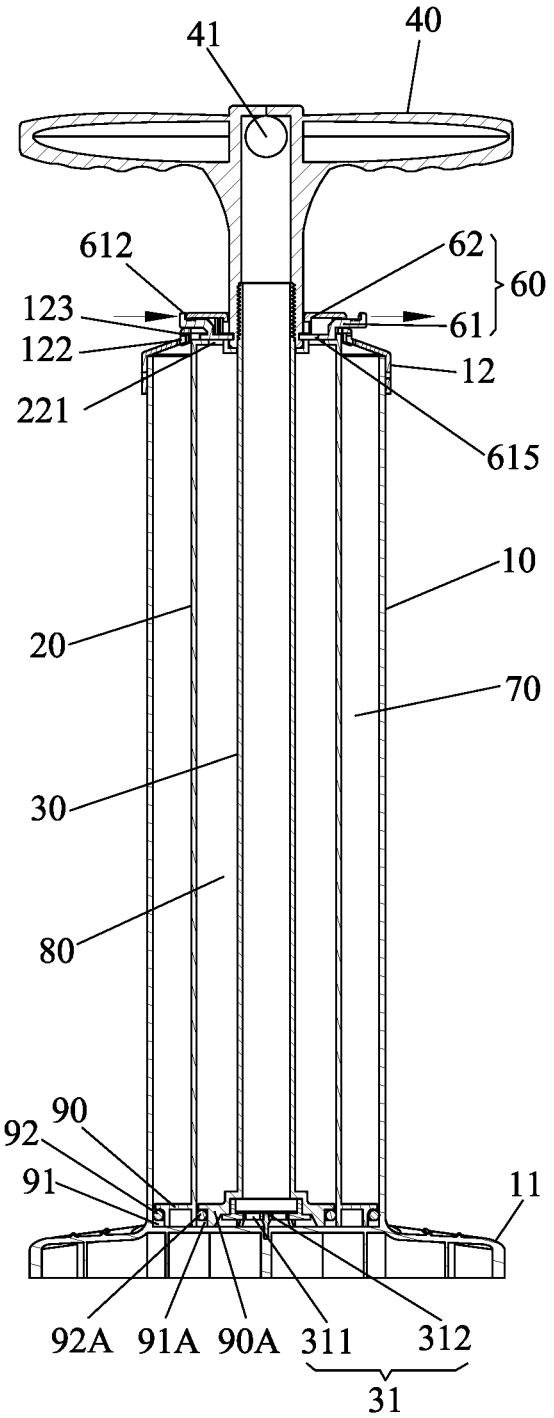
FIG. 16 is a cross-sectional view of the inflating device of the present invention, where the inflating device is switched into a large pump unit.
Figure 17:
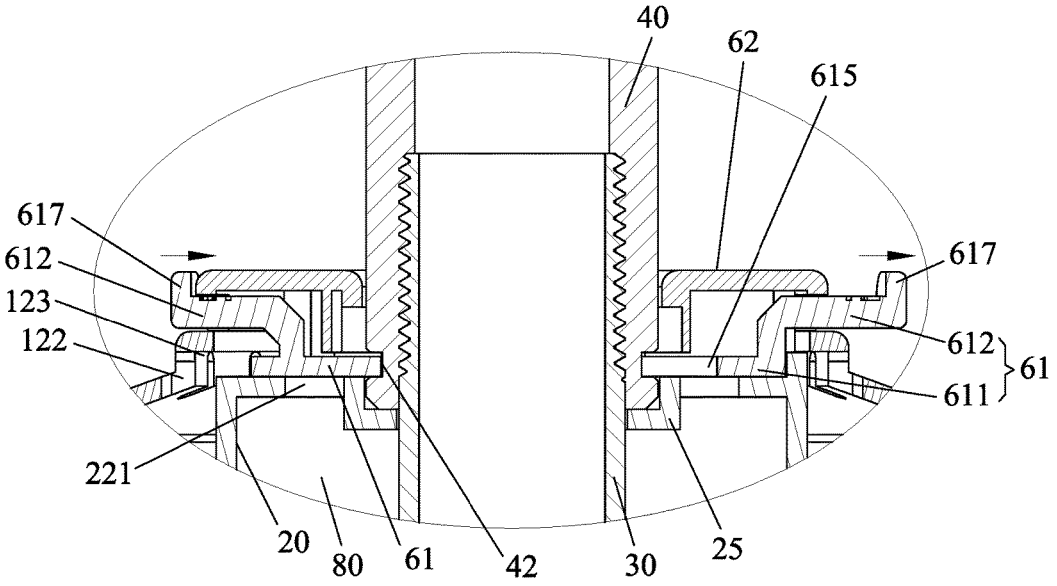
FIG. 17 is an enlarged cross-sectional view of FIG. 16 showing that the switching structure and some elements near the switching structure are enlarged to clarify its structure condition.
Figure 18:
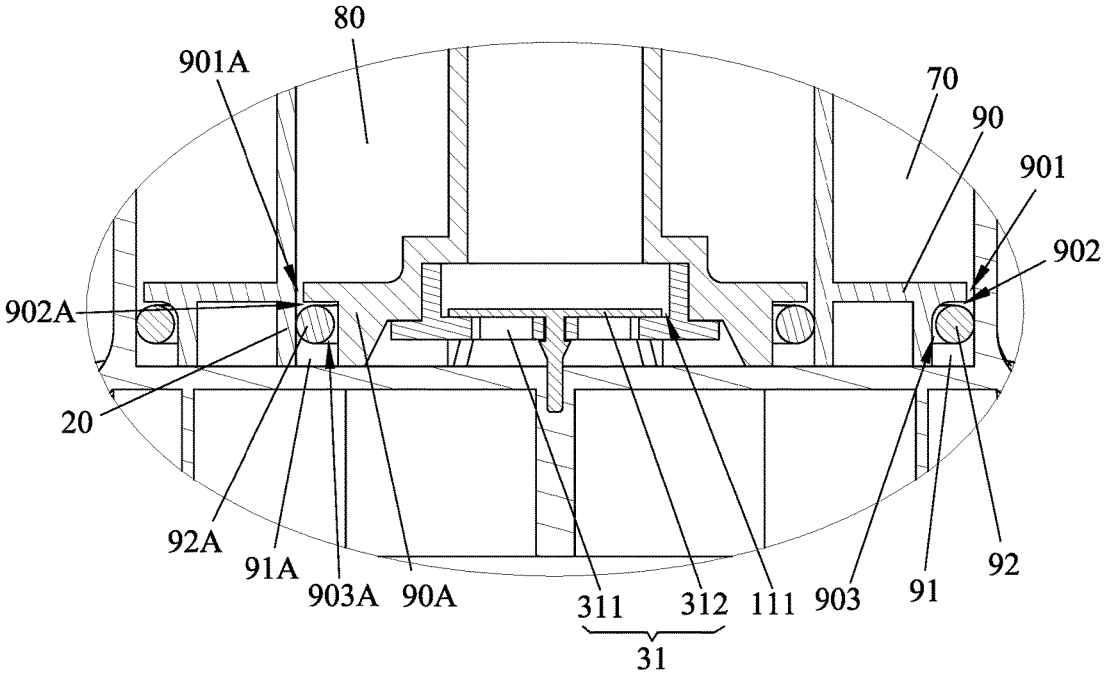
FIG. 18 is an enlarged cross-sectional view of FIG. 16 showing that bottom portions of the outer and inner cylinders and some elements near bottom portions of the outer and inner cylinders are enlarged to clarify its structure condition.
Figure 19:
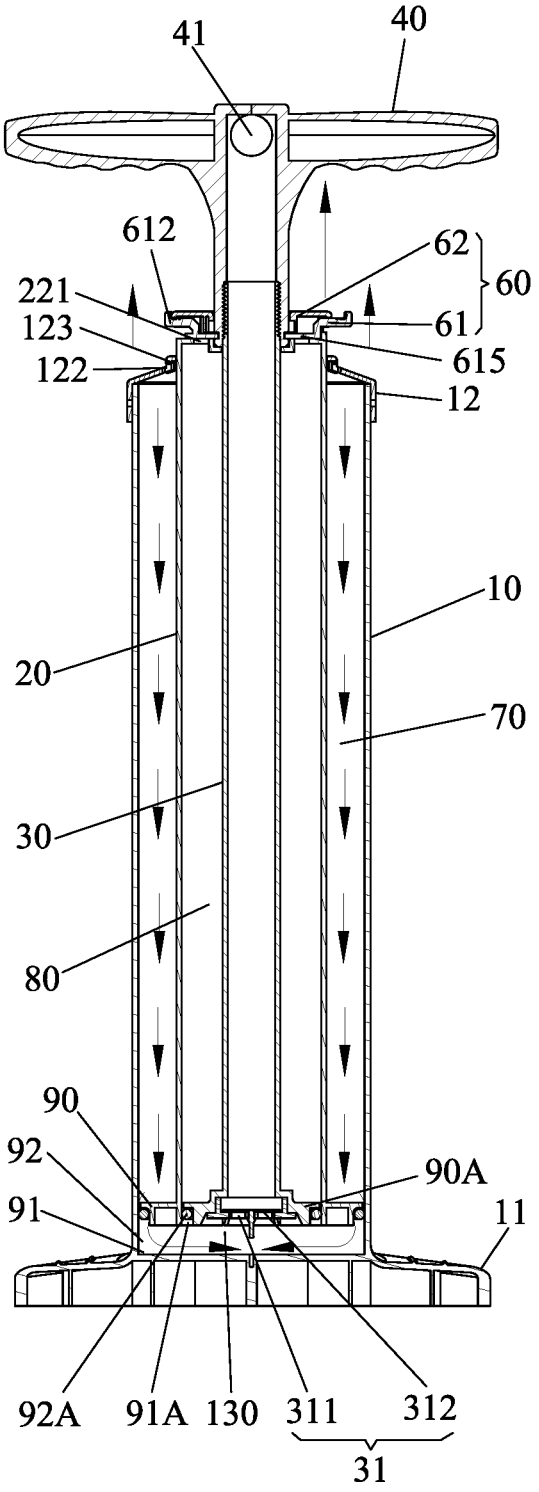
FIG. 19 is a cross-sectional view of the inflating device of the present invention showing that the handle drives the slide unit and the press cover of the switching structure, the outer and inner cylinders to move upward together.
Figure 20:
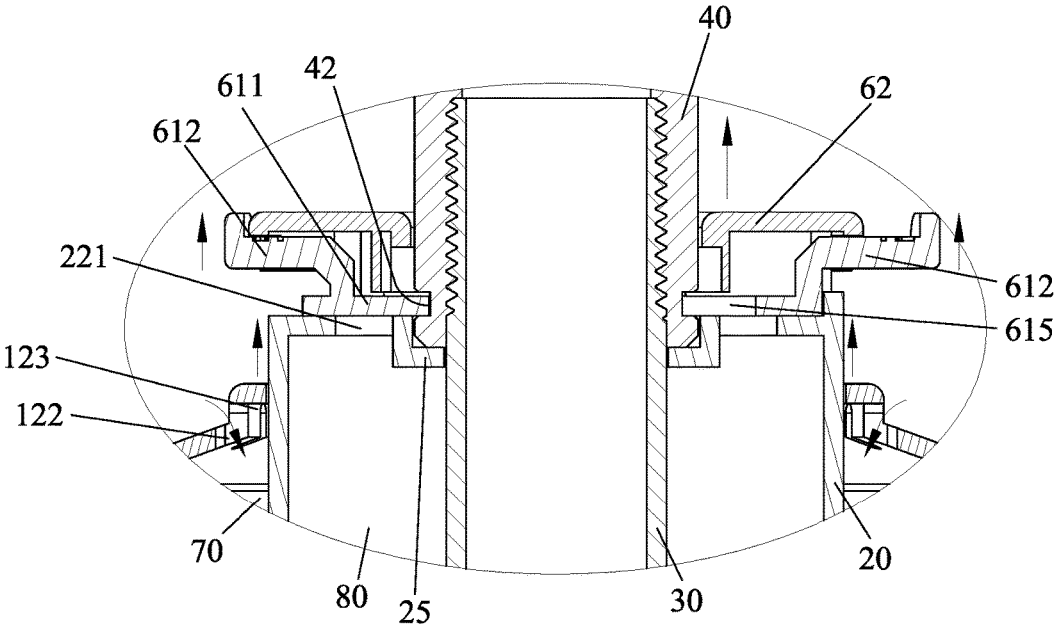
FIG. 20 is an enlarged cross-sectional view of FIG. 19 showing that the switching structure and some elements near the switching structure are enlarged to clarify its structure condition.
Figure 21:
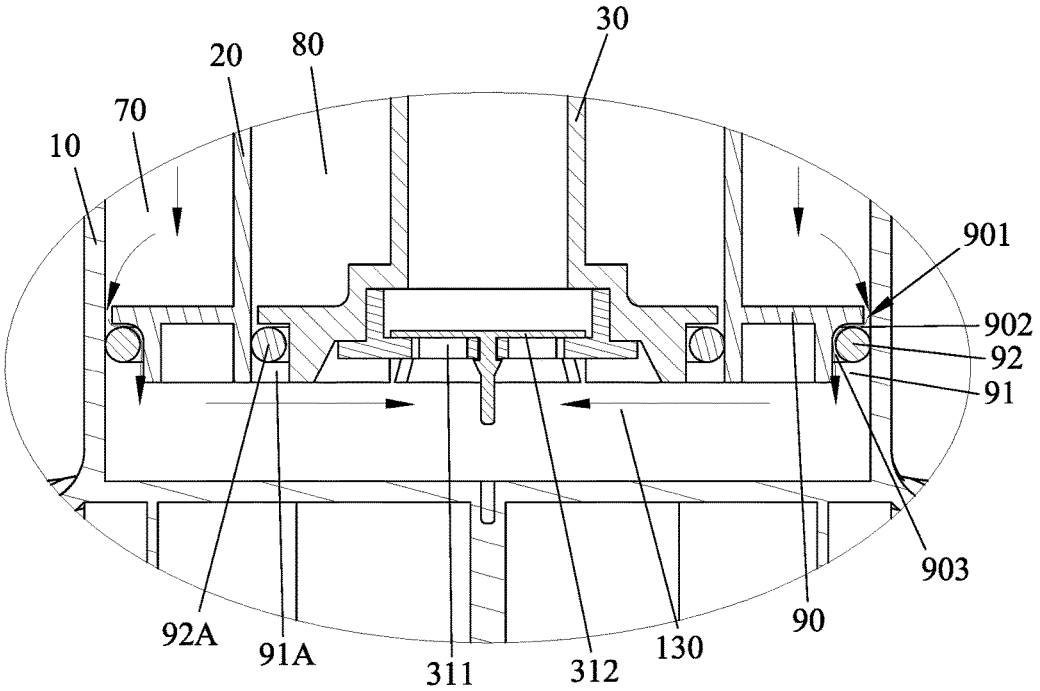
FIG. 21 is an enlarged cross-sectional view of FIG. 19 showing that bottom portions of the outer and inner cylinders and some elements near bottom portions of the outer and inner cylinders are enlarged to clarify its structure condition.

As best shown in FIGS. 16 and 18, the user's fingers hold the pulling portions 612 of the slide unit 61, and pull the slide plate 611 to slide within the sliding passage 213 in the right direction. Note that once the slide plate 611 is moved to the right direction in the sliding passage 213 until the other side of the outer periphery of the press cover 62 abuts against the other one of the finger-grips 617, the inner periphery defining the third circular hole 615 in the slide plate 611 engages to the engagement grove 42 of the handle 40, and the slide plate 611 is in connection with the handle 40. As best shown in FIGS. 19 to 21, because the slide plate 611 is in connection with the handle 40 and the press cover 62 and the outer cylinder 20 are securely connected to each other by the fasteners 100 and the slide plate 611 is located between the upper portion of the outer cylinder 20 and the press cover 62, when the user's hands hold the handle 40 and pull it up, the handle 40 is pulled up and pulls the slide unit 61 and the inner cylinder 30 to move up together, while the slide unit 61 pushes the press cover 62 up, and the press cover 62 pulls the outer cylinder 20 to move up with respect to the main body 10 by the fasteners 100, thereby exposing the first air inlet 122 of the top cover 12 to the atmosphere (permitting air to enter the first air chamber 70). Air can flow through the first air inlet 122 into the first air chamber 70. A pump chamber 130 is defined under the outer and inner cylinders 20, 30, after the outer and inner cylinder 20, 30 are moved up together. When the outer and inner cylinders 20, 30 are moved up together, the top surface of the first and second seal rings 92, 92A are away from the outer surface of the first and second pistons 90, 90A respectively and do not seal the second outer slit and 902 the second inner slit 902A respectively, so that the second outer slit 902 is open and can be in communication with the first outer slit 901, the second inner slit 902A is open and can be in communication with the first inner slit 901A. Therefore, the air in the first air chamber 70 can flow through the first outer slit 901, the second outer slit 902, the third outer slit 903 and first annular recess 91 in turn and enter into the pump chamber 130 under the outer and inner cylinders 20, 30.

Figure 22:
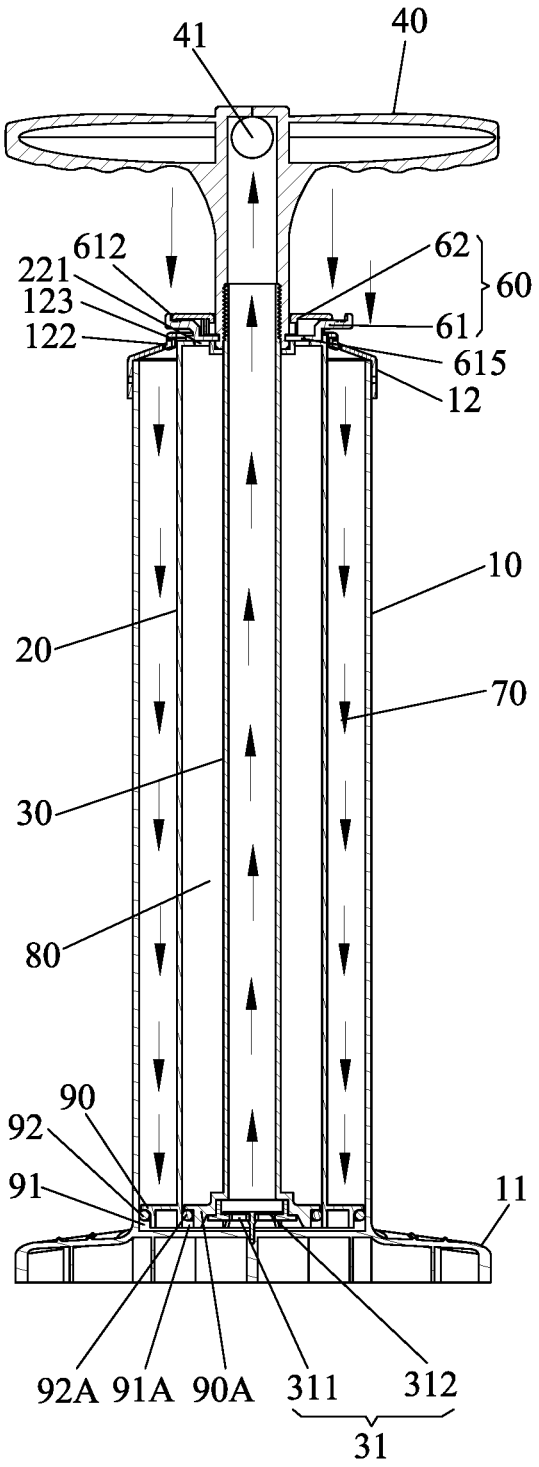
FIG. 22 is a cross-sectional view of the inflating device of the present invention showing that the handle drives the slide unit and the press cover of the switching structure, the outer and inner cylinders to move downward together.
Figure 23:
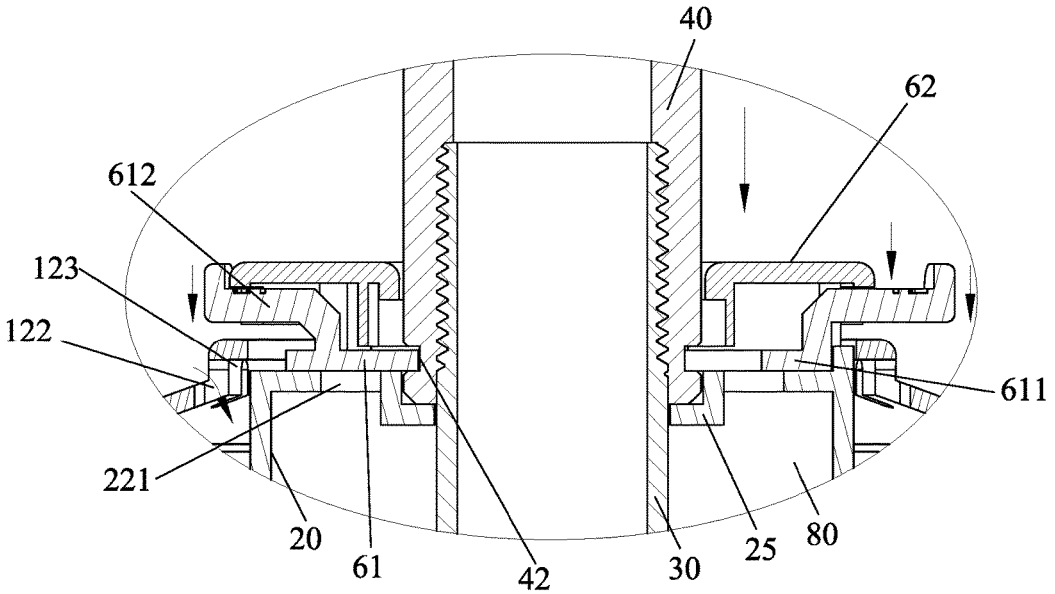
FIG. 23 is an enlarged cross-sectional view of FIG. 22 showing that the switching structure and some elements near the switching structure are enlarged to clarify its structure condition.
Figure 24:
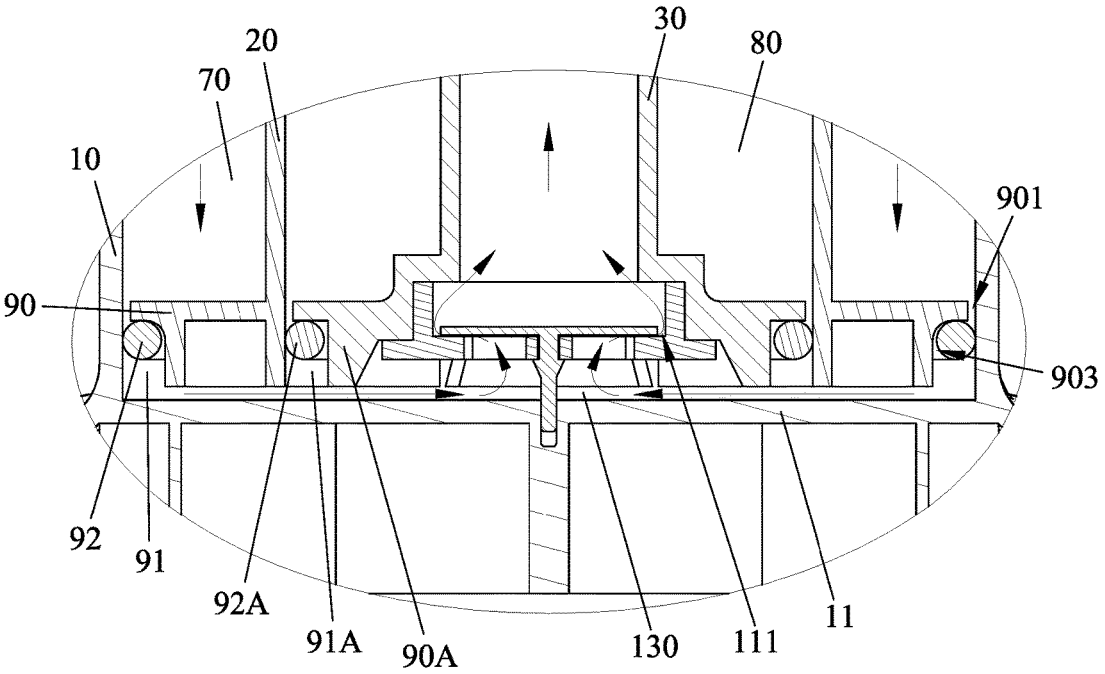
FIG. 24 is an enlarged cross-sectional view of FIG. 22 showing that bottom portions of the outer and inner cylinders and some elements near bottom portions of the outer and inner cylinders are enlarged to clarify its structure condition.

As shown in FIGS. 22 to 24, the user's hands push the handle 40 down. The handle 40 is pushed down and pushes the slide unit 61 and the outer and inner cylinders 20, 30 to move down together with respect to the main body 10, while the outer cylinder 20 pulls the press cover to move down by the fasteners. When the outer and inner cylinders 20, 30 are moved down together, the top surface of the first and second seal rings 92, 92A abut against the outer surface of the first and second pistons 90, 90A respectively and seal the second outer slit 902 and the second inner slit 902A respectively, the second outer slit 902 is sealed by the first seal ring 92 and cannot be in communication with the first outer slit 901, the second inner slit 902A is sealed by the second seal ring 92A and cannot be in communication with the first inner slit 901A. The air in the first air chamber 70 cannot flow through the second outer slit 902 so that the air cannot enter into the pump chamber 130 under the outer and inner cylinders 20, 30. The first piston 90 and the second piston 90A push down the air in the pump chamber 130 under the outer and inner cylinders 20, 30 and the air flows through the air aperture 311 to blow the floating shield 312 up and further flows through the gap 111 defined between the outer surface of the floating shield 312 and the inner surface of the inner cylinder 30 into the interior of the inner cylinder 30. Finally, as best shown in FIG. 22, the air in the interior of the inner cylinder 30 flows through the air outlet 41 of the handle 40 and the inflating tube 50 and enter into an inflatable article (not shown). In other words, the inflating device of the present invention provides a large injection pressure upon downward movement of the handle 40 together with the inner cylinder 30 and the switching structure 60 and the outer cylinder 20 with respect to the main body 10. Therefore, the inflating device of the present invention serves as a large pump unit.

An important aspect to note that since the outer cylinder 20 is disposed within the main body 10 and the inner cylinder 30 is disposed within the outer cylinder 20, and the slide unit 61 can selectively connect to the handle 40, the inflating device of the present invention can be switched between two different modes which are the small pump unit and the large pump unit by the switching structure 60, the inflating ability thereof is enhanced. The user can optionally switch to a desired mode (the small pump unit or the large pump unit) according to the circumstance requires.

Moreover, the switching structure 60 has simple structure and is easy to be install. When the inflatable article is inflated by the inflating device of the present invention, the slide unit 61 slides within the sliding passage 213 in the left and right directions so as to be separated from or in connection with the handle 40, the inflating device of the present invention can be switched between the small pump unit and the large pump unit. This kind of switching means is very fast and has high efficiency.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An inflating device comprising:

a main body having a bottom seat, an upper portion and a top cover mounted on and shielding the upper portion of the main body, the top cover defining a first circular hole and a first air inlet;

an outer cylinder disposed within the main body and having an upper portion that extends through the first circular hole in the top cover of the main body, the upper portion of the outer cylinder defining a cavity, a second air inlet and a second circular hole below the cavity, one side of the cavity defining a first notch and the other side of the cavity defining an opening, the cavity having a bottom surface defining a sliding passage, a first air chamber defined between an outer surface of the outer cylinder and an inner surface of the main body, the first air inlet in the top cover being in communication with the first air chamber, the outer cylinder having a bottom portion and the bottom portion of the outer cylinder having a first piston, a first outer slit defined between an outer surface of the first piston and the inner surface of the main body, the first outer slit being communication with the first air chamber;

an inner cylinder disposed within the outer cylinder and having an upper portion that extends through the second circular hole of the outer cylinder, a second air chamber defined between an outer surface of the inner cylinder and an inner surface of the outer cylinder, the second air inlet of the outer cylinder being in communication with the second air chamber, the inner cylinder having a bottom portion and the bottom portion of the inner cylinder having a second piston and a one-way valve, a first inner slit defined between an outer surface of the second piston and the inner surface of the outer cylinder, the first inner slit being in communication with the second air chamber;

a handle having an air outlet and a lower portion for coupling with the upper portion of the inner cylinder and abutting against the upper portion of the outer cylinder and formed with an engagement groove;

an inflating tube connected securely with the air outlet of the handle; and a switching structure including a slide unit and a press cover, the slide unit disposed slidably in left and right directions within the sliding passage and defining a third circular hole and having two opposite pulling portions, the press cover mounted on the upper portion of the outer cylinder so as to cover the cavity and the slide unit and having a fourth circular hole in alignment with the third circular hole in the slide unit and a pair of second notches in alignment with the first notch and the opening of the cavity and permitting extension of the pulling portions of the slide unit through the first notch and the opening of the cavity and the second notches of the press cover, the slide unit located between the upper portion of the outer cylinder and the press cover;

wherein the lower portion of the handle extends slidably and axially through the fourth circular hole in the press cover and the third circular hole in the slide unit for securely coupling to the upper portion of the inner cylinder in such a manner that the engagement groove selectively engages an inner periphery defining the third circular hole in the slide unit;

wherein the cavity further has at least one restricting post mounted erectly on a bottom surface of the sliding passage, the slide unit is formed with at least one slide limit slot to permit extension of the at least one restricting post in order to restrict sliding action of the slide unit in the left and right directions;

wherein the press cover has a bottom side surface formed with at least one connection post, the at least one connection post of the press cover is in connection with the at least one restricting post of the outer cylinder in such a manner that the press cover and the outer cylinder are securely connected to each other;

wherein when the slide unit slides within the sliding passage in the left and right directions and the inner periphery defining the third circular hole in the slide unit disengaging from the engagement groove of the handle, the slide unit is separated from the handle, the handle is pulled up or pushed down and pulls or pushes the inner cylinder to move up or down with respect to the outer cylinder and the main body;

wherein when the slide unit slides within the sliding passage in the left and right directions and the inner periphery defining the third circular hole in the slide unit engages to the engagement groove of the handle, the slide unit is in connection with the handle, the handle is pulled up and pulls the slide unit and the inner cylinder to move up together, while the slide unit pushes the press cover up, and the press cover pulls the outer cylinder to move up with respect to the main body; and wherein when the slide unit slides within the sliding passage in the left and right directions and the inner periphery defining the third circular hole in the slide unit engages to the engagement groove of the handle, the slide unit is in connection with the handle, the handle is pushed down and pushes the slide unit and the outer and inner cylinders to move down together with respect to the main body, while the outer cylinder pulls the press cover to move down.

2. The inflating device according to claim 1, wherein the one-way valve is constituted by an air aperture formed through the bottom portion of the inner cylinder and a floating shield floatingly covering the air aperture, the bottom portion of the inner cylinder further has a lowermost surface with the air aperture being located at an elevation above and extending through the lowermost surface while the floating shield is disposed within the inner cylinder for floatingly covering the air aperture.

3. The inflating device according to claim 1, wherein the outer surface of the first piston is formed with a first annular recess, in which, a first seal ring is disposed in the first annular recess, a second outer slit is defined between the outer surface of the first piston and a top surface of the first seal ring, and the second outer slit is selectively in communication with the first outer slit, a third outer slit is defined between the outer surface of the first piston and an inner surface of the first seal ring, and the third outer slit is in communication between the second outer slit and the first annular recess; and wherein the outer surface of the second piston is formed with a second annular recess, in which, a second seal ring is disposed in the second annular recess, a second inner slit is defined between the outer surface of the second piston and a top surface of the second seal ring, and the second inner slit is selectively in communication with the first inner slit, a third inner slit is defined between the outer surface of the second piston and an inner surface of the second seal ring, and the third inner slit is in communication between the second inner slit and the second annular recess.

4. The inflating device according to claim 1, wherein the press cover has an external wall surface formed with a plurality of grip-portions to facilitate gripping of the press cover during mounting of the press cover on the upper portion of the outer cylinder.

5. The inflating device according to claim 1, wherein the second air inlet of the outer cylinder is formed through the bottom surface of the sliding passage, and is constituted by a plurality of elongated slots and a plurality of third notches formed along an inner periphery defining the second circular hole of the outer cylinder.

6. The inflating device according to claim 1, wherein a plurality of first air inlets are formed around a section of an outer periphery of the top cover.

7. The inflating device according to claim 1, wherein the bottom side surface of the press cover is formed with a plurality of connection posts, the cavity further has a plurality of restricting posts mounted erectly on the bottom surface of the sliding passage, the connection posts of the press cover are in connection with the restricting posts of the outer cylinder in such a manner that the press cover and the outer cylinder are securely connected to each other, a confining curved plate interconnecting adjacent two of connection posts so as to restrict sliding action of the slide unit in the left and right directions and the upward and downward directions within the sliding passage, each of curved plates is located in front of each of the pulling portions and is located above the slide plate; and wherein the slide unit further includes a pair of finger-grips respectively and upwardly extending from distal ends of the pulling portions to facilitate manipulation of the pulling portions in the left and right directions.

8. The inflating device according to claim 1, wherein the slide unit includes a slide plate having two opposite ends from which the pulling portions extend outwardly inclinedly with respect to the slide plate and two lateral sides interconnecting the opposite ends and formed with protrusions, the sliding passage is defined by two parallel side surfaces formed with a pair of restricting notches such that the protrusions respectively extend into the restricting notches to alternately engage two opposite ends of a respective one of the restricting notches when the slide plate slides within the sliding passage in the left and right directions.

9. The inflating device according to claim 8, wherein the cavity has two restricting posts mounted erectly on the bottom surface of the sliding passage, the slide plate is formed with a pair of slide limit slots to permit extension of the two restricting posts in order to restrict sliding action of the slide plate in the left and right directions.

10. The inflating device according to claim 8, wherein the top cover further defines an annular inner edge at a bottom side thereof, the slide plate has an extension portion below one of the pulling portions, the opening of the cavity is configured to permit extension of the extension portion prior to extending into the annular inner edge of the top cover.

* * * * *